United States Patent [19]

Ikeda et al.

[11] Patent Number: 4,789,509

[45] Date of Patent: Dec. 6, 1988

[54] METHOD FOR FIBRILLATING CARBONACEOUS FIBERS

[75] Inventors: Takeshi Ikeda; Hideo Handa; Keisuke Nakano, all of Kitakyushu, Japan

[73] Assignee: Mitsubishi Chemical Industries Ltd., Tokyo, Japan

[21] Appl. No.: 132,651

[22] Filed: Dec. 10, 1987

Related U.S. Application Data

[63] Continuation of Ser. No. 800,388, Nov. 21, 1985, abandoned.

[30] Foreign Application Priority Data

Nov. 21, 1984 [JP] Japan ..... 59-246912
Dec. 11, 1984 [JP] Japan ..... 59-261533

[51] Int. Cl.[4] ..... D01D 5/42; D01F 9/12

[52] U.S. Cl. ..... 264/29.2; 264/29.4; 264/136; 264/138; 264/145; 264/157; 264/290.7; 264/297.8; 264/290.2; 264/DIG. 8

[58] Field of Search ..... 264/29.2, 147, D47, 264/145, 146, 157, 160, 280, 288.4, 290.7, 292, 297.8, 349, DIG. 8, 29.4, 136, 138, 290.2; 425/301, 366; 57/907; 28/245

[56] References Cited

U.S. PATENT DOCUMENTS 2,531,234 11/1950 Seckel ..... 264/DIG. 47
2,709,425 5/1955 Steckel et al. ..... 425/366
3,001,358 9/1961 Mayner ..... 57/140

FOREIGN PATENT DOCUMENTS 2460031 7/1975 Fed. Rep. of Germany .
1425246 2/1965 France .
58-36216 3/1983 Japan ..... 264/29.2
2030604 4/1980 United Kingdom .

OTHER PUBLICATIONS

Chemical Abstracts, vol. 98, No. 26, Jun. 1983, p. 78, Abstract No. 217084p, Columbus, Ohio, U.S.

*Primary Examiner*—Jan H. Silbaugh
*Assistant Examiner*—Herbert C. Lorin
*Attorney, Agent, or Firm*—Oblon, Fisher, Spivak, McClelland & Maier

[57] ABSTRACT

A method for fibrillating carbonaceous fibers, which comprises contacting a tow of carbonaceous fibers to rotating surfaces of rollers for fibrillation, wherein at least two rollers are disposed so that the center axes of the rollers intersect the direction of advance of the tow of carbonaceous fibers and the rotating surfaces of the rollers are substantially alternately inclined in opposite directions, thereby to exert a shearing force to the tow in a direction transverse to the direction of advance of the tow.

12 Claims, 8 Drawing Sheets

METHOD FOR FIBRILLATING CARBONACEOUS FIBERS

This application is a continuation of application Ser. No. 06/800,388, filed on Nov. 21, 1985, now abandoned.

The present invention relates to a method for fibrillating a tow of carbonaceous fibers.

Carbon fibers are commonly used as composite materials with various matrix resins. For example, they are impregnated with a matrix resin such as an epoxy resin, a polyamide resin or a phenol resin to obtain prepregs, which are then molded by various molding methods to obtain leisure or sports articles such as fishing rods, shafts of golf clubs or skis, or various industrial materials such as leaf springs, other springs or gear wheels, as fiber-reinforced plastics.

Such carbon fibers are produced usually by heating a tow of synthetic fibers such as polyacrylonitrile fibers in an oxidizing atmosphere such as air for flame resistant treatment, or heating a tow of fibers obtained by melt-spinning coal-originated pitch or petroleum pitch in an oxidizing atmosphere such as air for infusible treatment, followed by further heating in a high temperature inert gas atmosphere for carbonization or graphitization treatment.

However, a tow of fibers subjected to flame resistant or infusible treatment (hereinafter referred to simply as an "infusible-treated fiber tow") and a tow of fibers subjected to carbonization or graphitization treatment (hereinafter referred to simply as a "carbon fiber tow") lack flexibility due to e.g. the property changes, by heat, of an oiling agent used in the previous step or of fibers themselves during various steps, or fiber monofilaments are likely to fuse to one another, resulting in non-uniformity in the product quality, or the distribution of monofilaments in the matrix resin tends to be non-uniform, whereby the uniformity of the resulting composite material will be impaired. In order to avoid such disadvantages, it is necessary to "fibrillate" the fiber tow into a flexible and fusion-free state at some stage after the flame resistant treatment, infusible treatment, carbonization or graphitization. Heretofore, as a method for fibrillating an infusible-treated fiber tow or a carbon fiber tow, there have been proposed a method of subjecting the fiber tow to violent air stream treatment, a treating method in which the fiber tow is passed in a zig-zag manner along guides such as bars, wires or rotary pins, a method of contacting the fiber tow with a curved surface of a roll with a convex curved surface (Japanese Unexamined Patent Publication No. 57015/1980) and a method of fibrillating the fiber tow in a fluid (Japanese Unexamined Patent Publication No. 89638/1982).

However, none of such conventional methods is adequately satisfactory for the application to fibrillation of an infusible-treated fiber tow or a carbon fiber tow which lacks flexibility or in which fiber filaments are fused to one another.

Under these circumstances, the present inventors have conducted extensive research with an aim to develop a method whereby an infusible-treated fiber tow or a carbon fiber tow which lacks flexibility or in which fibers are fused to one another, is fibrillated by a simple operation into a flexible and fusion-free state without fluffing. As a result, it has been found possible to readily accomplish this object by contacting the fiber tow to inclined rotating surfaces of rollers, and the present invention has been accomplished based on this discovery.

The present invention provides a method for fibrillating carbonaceous fibers, which comprises contacting a tow of carbonaceous fibers to rotating surfaces of rollers for fibrillation, wherein at least two rollers are disposed so that center axes of the rollers intersect the direction of advance of the tow of carbonaceous fibers and the rotating surfaces of the rollers are substantially alternately inclined in opposite directions, thereby to exert a shearing force to the tow in a direction trasverse to the direction of advance of the tow.

Now, the present invention will be described in detail with reference to the preferred embodiments.

In the accompanying drawings.

The tow of carbonaceous fibers used in the present invention is the one obtained by subjecting a tow of fibers such as polyacrylonitrile fibers, cellulose fibers or polyvinyl alcohol fibers, to flame resistant treatment, carbonization treatment or graphitization treatment, or the one obtained by subjecting a tow of pitch fibers to infusible treatment, carbonization treatment or graphitization treatment.

Particularly in the case of the pitch fiber tow, the degree of losing the flexibility or the degree of fusion of fibers to one another tends to increase rapidly as compared with e.g. a polyacrylonitrile fiber tow, as the heat treatment progresses from infusible treatment to carbonization and graphitization. In such a case, the fibrillation may be conducted firstly at the stage of the infusible-treated fiber tow and again at the stage of the carbon fiber tow.

The number of fiber filaments constituting a tow is not particularly restricted, but a tow is usually composed of from 300 to 300,000 filaments, preferably from 500 to 60,000 filaments.

The rollers to be used in the present invention, may be tapered rollers having inclined rotating surfaces or rod-like or cylindrical rollers having a circular or oval cross section.

Figure 3:
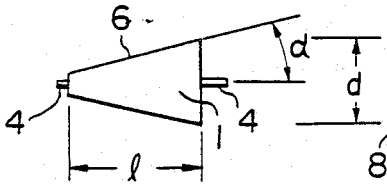
FIGS. 3 and 4 are front views of tapered rollers used in the present invention.
Figure 4:
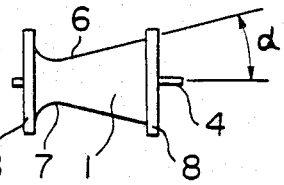

In the case of tapered rollers, they have a conical shape or the like as shown in FIG. 3, wherein the surfaces to contact with the tow of carbonaceous fibers are tapered surfaces 6 having an angle $\alpha$ of inclination of from 3° to 50°, preferably from 5° to 30°, relative to the center axes 4 of the rollers. If the angle $\alpha$ is less than 3°, no adequate fibrillation can be accomplished. On the other hand, if the angle $\alpha$ exceeds 50°, it becomes difficult to smoothly conduct the fibrillating operation since the fiber tow tends to be displaced towards the side having a smaller diameter, or the tow is bent excessively from one roller to another. The size of rollers may optionally be selected depending upon e.g. the number of carbonaceous fibers constituting the tow, the number of tows to be treated for fibrillation or the degree for fibrillation. However, it is usual to employ rollers having a diameter d at the large diameter side of from 0.5 to 5 cm and a length l of from 1 to 5 cm. As shown in FIG. 4, it is preferred to provide a curved portion 7 at the small diameter side and flanges 8 at both ends for the fibrillation operation.

Figure 13:
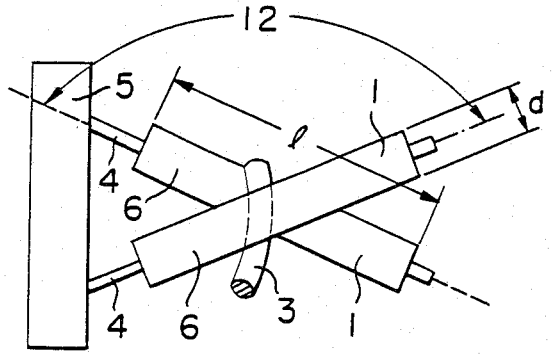
FIG. 13 is an enlarged view taken along A—A of FIG. 11.

In the case where the rollers are rod-like or cylindrical rollers, they may have a circular or oval cross section, and they are disposed as shown in FIG. 13. The size of rollers may optionally be selected depending upon the nature of the tow of carbonaceous fibers, the number of fibers constituting the tow, the number of tows to be treated or the degree for fibrillation. However, it is usual to employ rollers having a diameter (a shorter diameter in the case of an oval cross section) d of from 0.5 to 5 cm and a length l of from 1 to 5 cm and provided with a center shaft or a through-hole for a shaft. As in the case of the tapered rollers, it is preferred that the rollers are provided with flanges (not shown) a both ends for smooth fibrillation operation.

In the present invention, it is important that at least two rollers are disposed so that center axes of the rollers intersect the direction of advance of the tow of carbonaceous fibers and the rotating surfaces of the rollers are substantially alternately inclined in opposite directions. The disposition of the rollers so that their center axes intersect the direction of advance of the tow of carbonaceous fibers, means the arrangement of the rollers so that the fiber tow is brought in contact with the rotating surfaces of the rollers and receives a shearing force to separate the fused fibers. Likewise, the disposition of the rollers so that their rotating surfaces are substantially alternately inclined in opposite directions, means, in the case of tapered rollers, an arrangement of the rollers whereby the tapering directions of their tapered surfaces are substantially alternately opposite, i.e. the small and large diameter sides of adjacent tapered rollers are inversely located, and, in the case of rod-like or cylindrical rollers, an arrangement whereby the center axes of the adjacent rollers intersect each other as viewed from the direction of advance of the tow of carbonaceous fibers, as shown in FIG. 13. In any case, the alternate arrangement of a plurality of rollers may partly be discontinued by the provision of some rollers inclined in the same directions or by the provision of some rollers with their rotating surfaces not inclined.

The number and location of rollers may optionally be selected depending upon the degree of inflexibility of the tow of carbonaceous fibers and the degree of the fusion of fibers. It is usual to employ from 2 to 100, preferably from 4 to 60, more preferably from 6 to 40, rollers of the same size. However, from 2 to 5 kinds of rollers having different sizes may be used in a suitable combination.

In the case of tapered rollers, it is not necessary to incline the center axes of the tapered rollers, since they have tapered rotating surfaces. Whereas, in the case of rod-like or cylindrical rollers, they are disposed with their center axes inclined. Referring to FIG. 13, the angle of inclination is meant for an angle 12 of the intersecting center axes of the adjacent rollers as viewed from the direction of advance of the tow of carbonaceous fibers. The fibrillation operation is conducted at an angle 12 of from 5° to 100°, preferably from 10° to 60°. If the angle of inclination is less than 5°, no adequate fibrillation will be obtained. On the other hand, if the angle exceeds 100°, the fiber tow tends to be displaced towards roller ends or the tow is likely to be bent excessively from one roller to another, whereby it becomes difficult to smoothly conduct the fibrillation operation.

The arrangement of rollers may be in a linear type, an S-type, a W-type, a circular type or a combination thereof.

Firstly, the roller arrangements will be described with respect to an embodiment wherein tapered rollers are employed.

Figure 1:
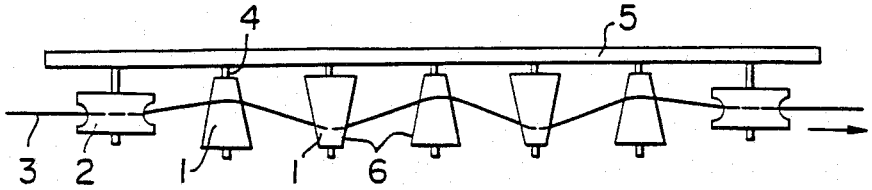
FIG. 1 is a plan view of an embodiment of an apparatus used for the present invention.
Figure 2:
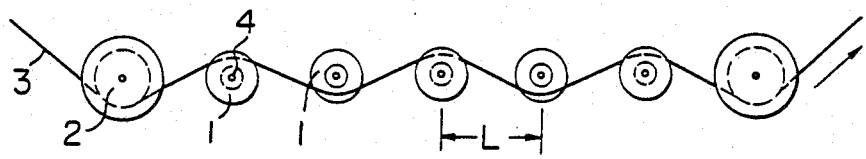
FIG. 2 is a front view of the apparatus.

FIG. 1 is a plan view of an arrangement of the linear type, and FIG. 2 is a front view thereof. Tapered rollers 1 are rotatably supported on center shafts 4 linearly provided on a roller support frame 5, with their tapering surfaces 6 being alternately opposite. (In the Figure, five rollers are illustrated.) As shown in FIG. 2, the distance L between the center shafts 4 of adjacent rollers is usually from 0.5 to 5 cm, although it may depend upon the angle $\alpha$ of the tapering surface and the size of the rollers. The tow 3 of carbonaceous fibers is stretched from a guide roller 2 via the upper and lower sides of the tapered surfaces 6 of the respective adjacent rollers 1 alternately to a guide roller 2 at the opposite end.

When a winding-up bobbin (not shown) is rotated, the tow 3 of carbonaceous fibers is pulled in the direction shown by the arrow, and is brought in contact with the tapering surfaces 6 with the tapering directions being alternately opposite, whereby the tow of carbonaceous fibers is subjected to a shearing force in a direction transverse to the direction of advance of the tow alternately. Namely, the tow will receive a shearing force to separate the fused fibers.

Figure 5A:
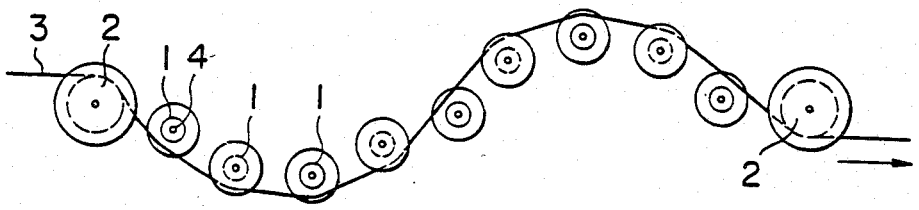
Figure 5B:
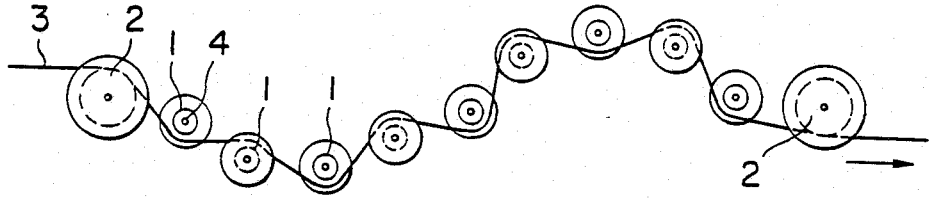
Figure 5C:
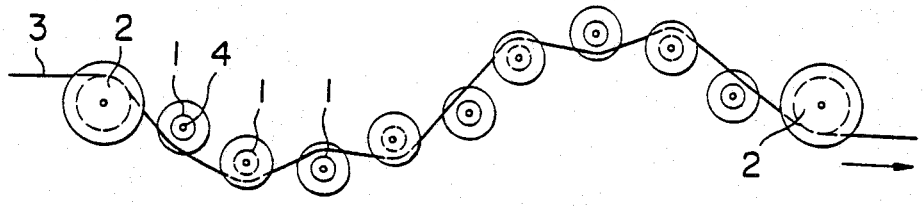

In the case of an S-type arrangement, tapered rollers 1 are arranged in the shape of letter S, as shown in FIG. 5.

The tow 3 of carbonaceous fibers is stretched so that it is in contact with the outer sides of the tapered rollers arranged in the form of letter S, and pulled in the direction shown by the arrow (as illustrated in FIG. 5 (*a*)). The tow of carbonaceous fibers may be stretched in various other methods including a method as shown in FIG. 5 (*b*) in which the tow is stretched via the inner and outer sides of the tapered roller alternately, and a method as shown in FIG. 5 (*c*) wherein the tow is stretched via the outer sides of two adjacent rollers and then via the inner side of one roller successively.

Figure 6:
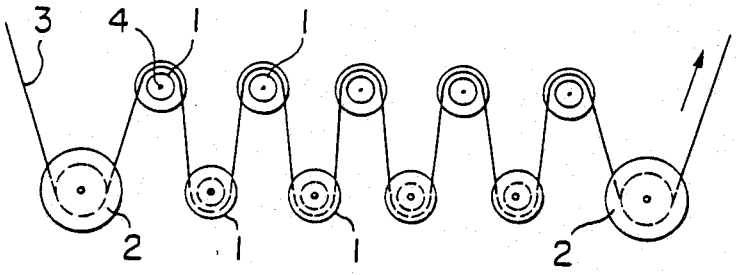
FIGS. 5 to 8 illustrate other arrangements of the tapered rollers.

In the case of a W-type, tapered rollers 1 are arranged in two rows, as shown in FIG. 6. The tow 3 of carbonaceous fibers is stretched in a pattern ot letter W between the tapered rollers 1 and pulled in the direction shown by the arrow.

Figure 7A:
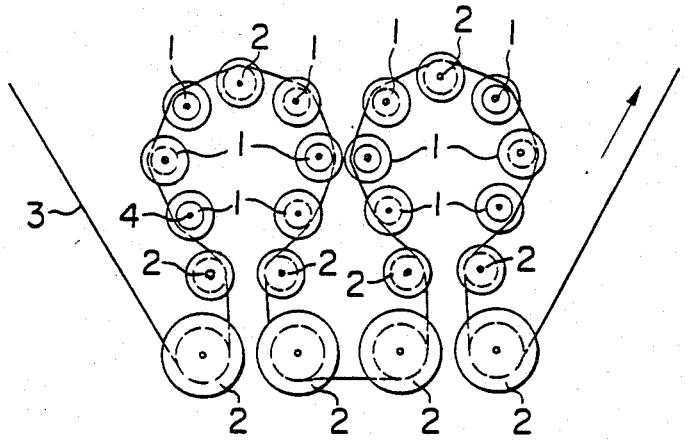
Figure 7B:
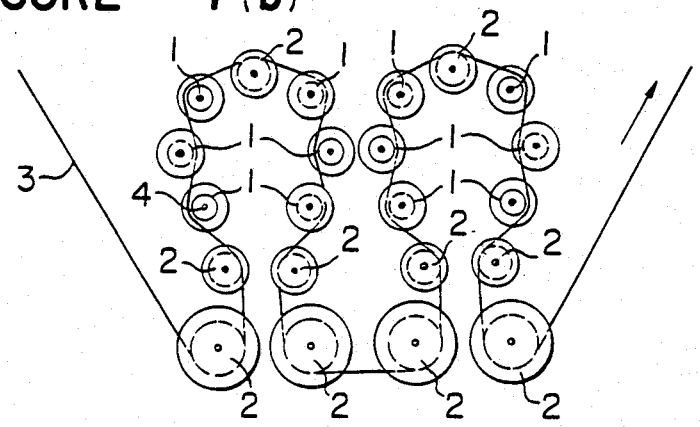
Figure 7C:
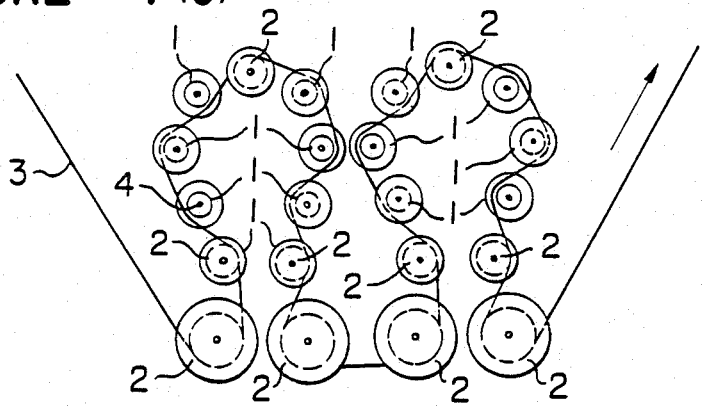
Figure 8:
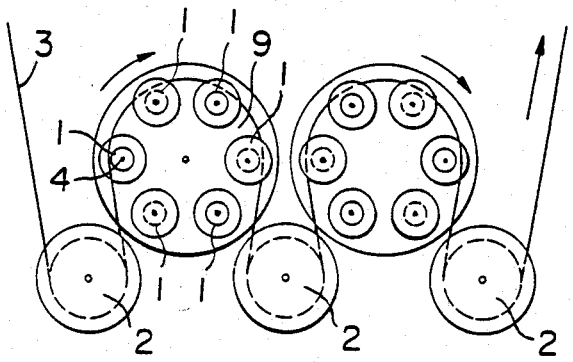

In the case of a circular type, tapered rollers 1 are arranged in a circular pattern, as shown in FIG. 7, or tapered rollers 1 are arranged in a circular pattern on a rotary plate 9, as shown in FIG. 8. The tow 3 of carbonaceous fibers may be stretched so that it is in contact with the outer sides of the tapered rollers arranged in a circular pattern, and pulled in the direction shown by the arrow (FIG. 7 (*a*)). Like in tne case of the S-type, various stretching methods may be employed in the circular type arrangement (e.g. as illustrated in FIG. 7 (*b*) and (*c*)).

Now, the invention will be described with respect to another embodiment wherein rod-like or cylindrical rollers are employed.

Figure 11:
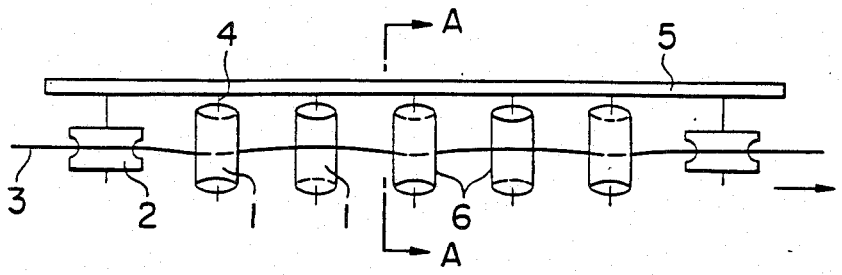
FIG. 11 is a plan view of another embodiment of the apparatus used in the present invention.
Figure 12:
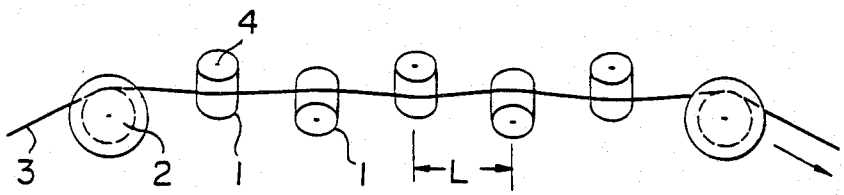
FIG. 12 is a front view thereof.

FIG. 11 is a plan view of a linear type arrangement, and FIG. 12 is a front view thereof. Rollers 1 are rotatably supported on center shafts 4 provided in an alternately inclined manner on a roller support frame 5. (In the Figure, five rollers are illustrated.) As shown in FIG. 12, the distance L between the center shafts 4 of the adjacent rollers is usually from 2 to 10 cm although it may vary depending upon tne angle of inclination of the center shafts or upon the size of tne rollers. The tow 3 of carbonaceous fibers is stretched from a guide roller 2 via the upper and lower sides of the rotating surfaces 6 of the respective adjacent rollers 1 alternately to a guide rollers 2 at the opposite end. When a winding-up bobbin (not shown) is rotated, the tow 3 of carbonaceous fibers is pulled in the direction shown by the arrow and brought in contact with the rotating surfaces 6 of rollers 1 alternately inclined in opposite directions, whereby a shearing force is exerted to the tow of carbonaceous fibers alternately in the opposite directions transverse to the direction of advance of the tow. Namely, the tow will receive a shearing force to separate the fused fibers.

Figure 14A:
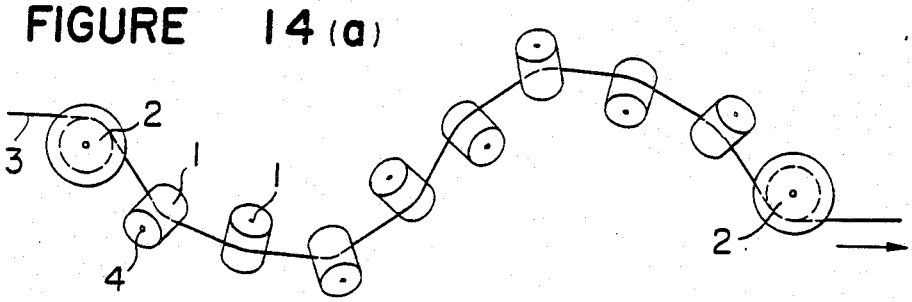
FIGS. 14 to 16 illustrate other arrangements of the rod-like rollers.
Figure 14B:
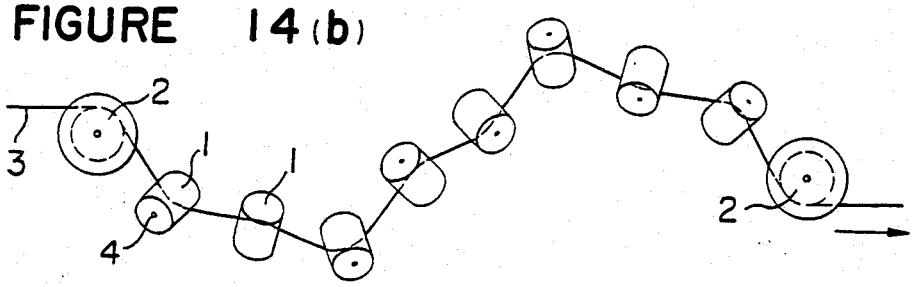
Figure 14C:
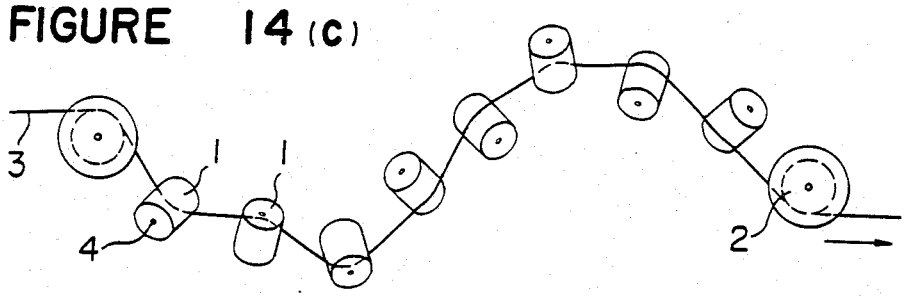

In the case of an S-type arrangement, rollers 1 are disposed with alternate inclinations in a pattern of letter S, as shown in FIG. 14. The tow 3 of carbonaceous fibers is stretched so that it is in contact with the outer sides of the rollers arranged in the pattern of letter S, and pulled in the direction shown by the arrow (FIG. 14 (*a*)). Various other stretching methods may be employed (e.g. as illustrated in FIG. 14 (*b*) and (*c*)). There is no particular restriction so long as a shearing force is imparted alternately in the direction transverse to the direction of advance of the tow.

Figure 15:
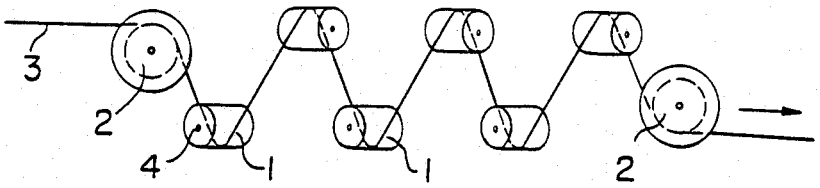

In the case of a W-type arrangement, rollers 1 are arranged in two rows of rollers inclined in the same direction, as shown in FIG. 15. The tow 3 of carbonaceous fibers is stretched between the two rows of rollers 1 in a pattern of letter W, and pulled in the direction shown by the arrow.

Figure 16:
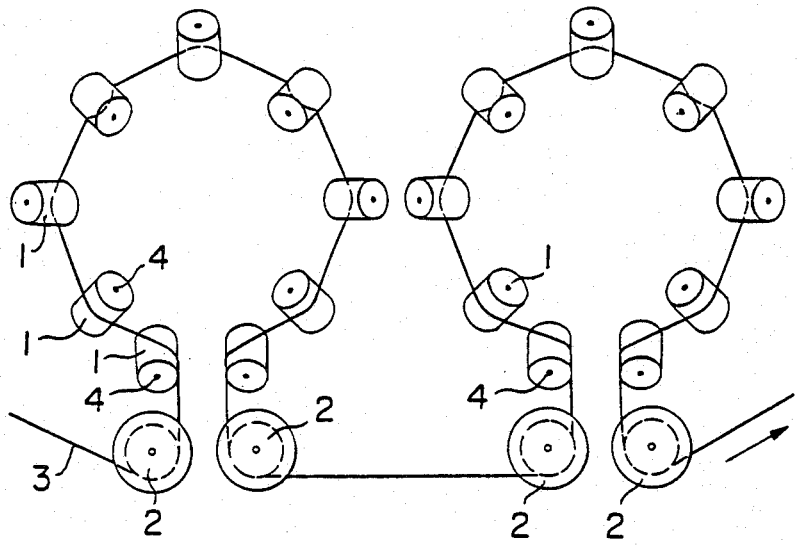
Figure 16:
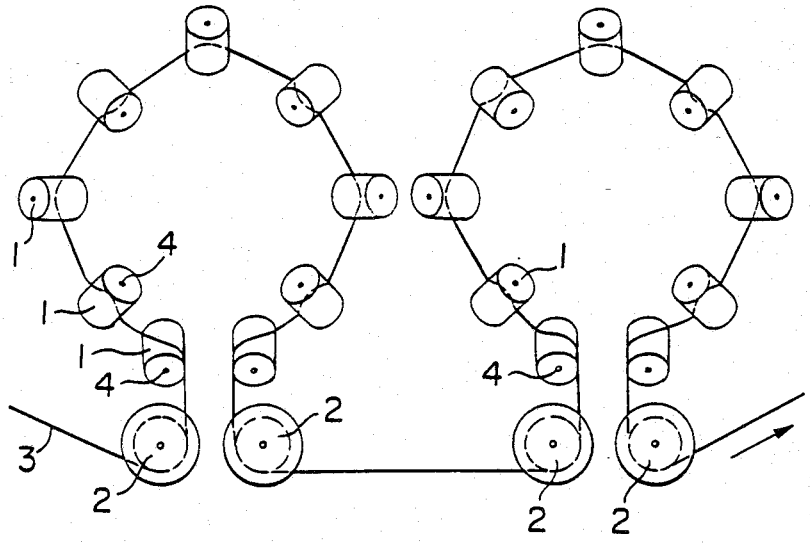
Figure 16C:
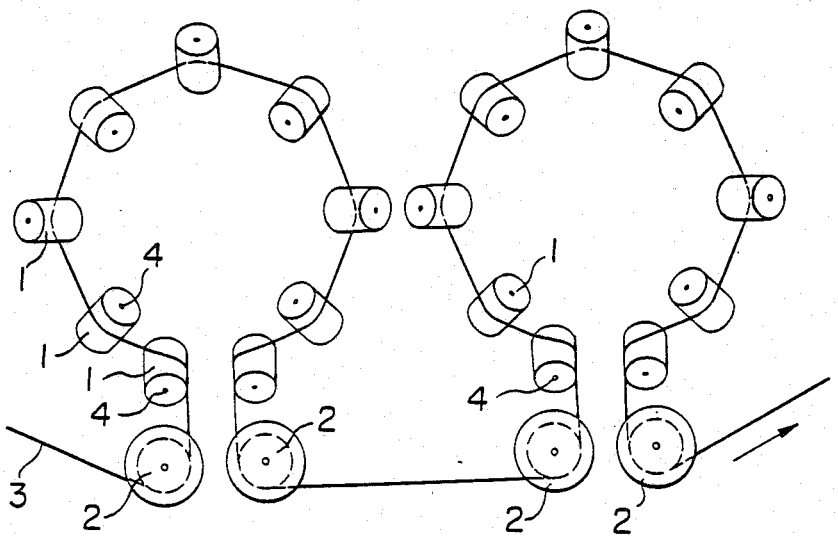

In the case of a circular type arrangement, rollers 1 are disposed with alternate inclinations in a circular pattern, as shown in FIG. 16. The tow 3 of carbonaceous fibers is stretched in a circular pattern and pulled in the direction shown by the arrow (FIG. 16 (*a*)). As in the case-of the S-type arrangement, various other stretching methods may be employed (e.g. as illustrated in FIG. 16 (*b*) and (*c*)).

The fibrillation may be conducted in a gas phase. However, the fibrillation is preferably conducted in water or in an aqueous solution of a water-soluble substance e.g. an alcohol or a surfactant selected from an anion surfactant, a cation surfactant, a non-ionic surfactant, an amphoteric surfactant or a mixture thereof, and/or in such a state in which the tow of carbonaceous fiber are wetted with water or with the above-mentioned aqueous solution of a water-soluble substance, whereby the fibrillation operation can be conducted smoothly without fluffing. The concentration of water-soluble substances is preferably from 0.01 to 5% by weight in the case of a surfactant, although it may vary depending upon the substance. In the case where the substance remaining in the fibers after the fibrillatron create a trouble, such substance may be removed by washing with water atter the fibrillation.

Further, an acid such as sulfuric acid or nitric acid, a base such as sodium hydroxide or potassium hydroxide, or a salt such as sodium chloride or potassium carbonate, may also be used as a water-soluble substance. The tow of carbonaceous fibers fibrillated by means of an aqueous solution of such a substance, may be subjected to surface treatment such as wet oxidation or electrolytic oxidation by means of the same aqueous solution of such a substance.

According to the present invention, the tow of inflexible or partially fused fibers can readily be fibrillated to a flexible state by a simple operation which comprises contacting the tow of carbonaceous fibers to rotating surfaces of rollers for fibrillation wherein at least two rollers are disposed so that the center axes of the rollers intersect the direction of advance of the tow and the rotating surfaces of the rollers are substantially alternately inclined in opposite directions. Thus, the present invention is superior as a method for fibrillating carbonaceous fibers.

Now, the present invention will be described in further detail with reference to Examples. However, it should be understood that the present invention is by no means restricted to these specific Examples.

EXAMPLE 1

Twelve tapered rollers having a larger diameter (d) of 1.6 cm, a length (l) of 2 cm and an angle (*a*) of inclination of 13° were arranged as shown in FIG. 7 (*a*) with the distance (L) between the center axes of the adjacent rollers being 2 cm, and total of ten guide rollers were provided at both ends and intermediate locations. Such an apparatus was installed in a water tank containing an aqueous solution which contains about 0.1% by weight of an anion surfactant.

A carbon fiber tow-obtained by melt spinning a coal-originated pitch, followed by infusible treatment and carbonization and composed of 3000 fiber filaments each with a diameter of 10 μm, was put on this apparatus as shown in FIG. 7, and the fibrillated tow from the apparatus was washed with water and wound up at a rate of about 2 m/min, and then dried.

Figure 9:
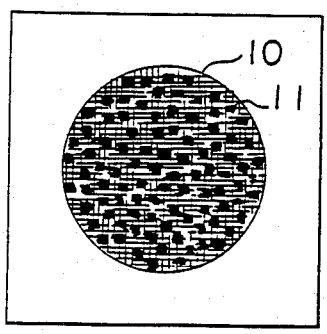
FIGS. 9 and 10 are diagrammatic views illustrating the distributions of fibers in epoxy resins.

The fibrillated tow thus obtained was flexible and free from fusion of the fibers to one another. It was impregnated in a matrix epoxy resin, and then cured, and thereafter, the cross section relative to the longitudinal direction of the tow was observed by a scanning type electron microscope, whereby excellent uniform quality with the uniform distribution of fiber filaments 10 in the epoxy resin 11 was observed, as shown in FIG. 9.

Figure 10:
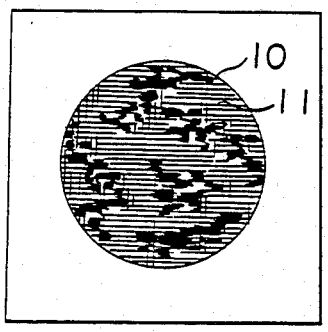

Whereas, the tow of carbon fibers prior to the fibrillation lacked flexibility and contained substantial fused fibers. The cross section was observed in the same manner, whereby it was found that fiber filaments 10 were coagulated as shown in FIG. 10 with non-uniform distribution in the epoxy resin 11.

EXAMPLE 2

A fibrillated tow was obtained in the same manner as in Example 1 except that the tow of carbonaceous fibers was an infusible-treated fiber tow, and the fibrillated tow was further subjected to carbonization to obtain a tow of carbon fibers. The tow thereby obtained was flexible, in which no fusion of fibers was observed. The cross section was observed in the same manner as in Example 1, whereby it was found that fiber filaments were unformly distributed and had uniform quality.

EXAMPLE 3

Six cylindrical rollers having a diameter (d) of 1.6 cm, a length (l) of 2 cm and an angle 12 of inclination of 30° were arranged as shown in FIG. 15 with the distance (L) between the center axes of the adjacent rollers being 3 cm, and two guide rollers were provided at both ends. Such an apparatus was installed in a water tank containing an aqueous solution which contains about 0.1% by weight of an anion surfactant.

A carbon fiber tow obtained by melt-spinning coal-originated pitch, followed by infusible treatment and carbonization and composed of 3000 fiber filaments each having a diameter of 10 μm, was put on this apparatus as shown in FIG. 15. The fibrillated tow discharged from the apparatus was washed with water and wound up at a rate of about 2 m/min, and then dried.

The fibrillated tow thereby obtained was flexible and free from fusion of fibers to one another. It was impregnated in a matrix epoxy resin, and then cured, and the cross section relative to the longitudinal direction of the tow was observed by a scanning type electron microscope, whereby it was found that the fibers were uniformly dispersed and- showed excellent uniform quality as in the case of Example 1.

EXAMPLE 4

A fibrillated tow was obtained in the same manner as in Example 3 except that the tow of carbonaceous fibers was an infusible-treated fiber tow, and the fibrillated tow was further subjected to carbonization to obtain a tow of carbon fibers. The tow was flexible and free from fusion of the fibers to one another, and the cross section of the tow was observed in the same manner as in Example 3, whereby it was found that fiber filaments were uniformly distributed and showed uniform quality.

We claim:

1. A method for fibrillating carbonaceous fibers, which are inflexible or which are fused to each other, said method thereby producing a flexible and fusion-free product which does not exhibit fluffing, which comprises:

contacting an advancing tow of said carbonaceous fibers with at least two spaced apart rollers which rotate and which are so positioned relative to each other that their center axes intersect the direction of said advancing tow of said carbonaceous fibers, the rollers having substantially alternately, rotating surfaces which are inclined in opposite directions to each other, the result of which contact is an exertion of a shearing force on said advancing tow in an alternately opposite direction transverse to said direction of said advancing tow of said carbonaceous fibers.

2. The method of claim 1, wherein said at least two spaced apart rollers are tapered rollers which are so positioned that they provide said substantially alternately inclined surfaces.

3. The method of claim 1, wherein said at least two spaced apart rollers are rod-like or cylindrically shaped rollers which have a circular or oval cross-section.

4. The method of claim 1, wherein said advancing tow of said carbonaceous fibers is contacted with said rotating surfaces of said rollers while wet with water.

5. The method of claim 1, wherein said advancing tow of said carbonaceous fibers is contacted with said rotating surfaces of said rollers in water.

6. The method of claim 2, wherein the taper of the surface of tapered said rollers is an angle of inclination ranging from 3° to 50° relative to said center axes of said rollers.

7. The method of claim 3, wherein said at least two spaced apart rollers are so positioned that the center axes of adjacent rollers form an intersecting angle, as viewed from the direction of advance of said tow of said carbonaceous fibers, of from 5° to 100°.

8. The method of claim 4, wherein said water contains a surfactant or an alcohol.

9. The method of claim 5, wherein said water contains a surfactant or an alcohol.

10. The method of claim 1, wherein said carbonaceous fibers are obtained by subjecting pitch fibers, polyacrylonitrile fibers, cellulose fibers or polyvinyl alcohol fibers to a treatment which imparts infusibility or flame resistance to the fibers.

11. The method of claim 1, wherein said carbonaceous fibers are obtained by subjecting pitch fibers, polyacrylonitrile fibers, cellulose fibers or polyvinyl alcohol fibers to a treatment which imparts infusibility or flame resistance to the fibers, followed bycarbonizing, graphitizing, or carbonizing and graphitizing, said fibers.

12. The method of claim 1, wherein said tow of said carbonaceous fibers comprises from 300 to 300,000 filaments.

* * * * *